US007313995B2

(12) United States Patent
Shah et al.

(10) Patent No.: US 7,313,995 B2
(45) Date of Patent: Jan. 1, 2008

(54) INCLINABLE MUNITIONS LAUNCHER

(75) Inventors: Tushar K. Shah, Columbia, MD (US); Grant W. Corboy, Baltimore, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 196 days.

(21) Appl. No.: 11/081,486

(22) Filed: Mar. 16, 2005

(65) Prior Publication Data

US 2006/0207417 A1 Sep. 21, 2006

(51) Int. Cl.
*F41F 3/04* (2006.01)

(52) U.S. Cl. ..... 89/1.815; 89/1.8

(58) Field of Classification Search ..... 89/1.817, 89/1.8, 1.806, 1.815, 41.01, 41.18; 463/50; 254/89, 89 H, 92, 133 A
See application file for complete search history.

(56) References Cited

U.S. PATENT DOCUMENTS

| | | | | | |
|---|---|---|---|---|---|
| 57,692 | A | * | 9/1866 | Eads | 89/41.01 |
| 2,345,747 | A | * | 4/1944 | Hake | 89/37.16 |
| 2,377,091 | A | * | 5/1945 | McFarland | 89/37.17 |
| 2,655,838 | A | * | 10/1953 | Ernst et al. | 89/41.12 |
| 2,826,960 | A | * | 3/1958 | Schiavi | 89/1.806 |
| 3,106,132 | A | * | 10/1963 | Biermann et al. | 89/1.815 |
| 3,217,900 | A | * | 11/1965 | Kupetzky et al. | 414/742 |
| 3,228,293 | A | * | 1/1966 | Kane et al. | 89/1.8 |
| 4,106,389 | A | | 8/1978 | Walley | |
| 4,141,277 | A | * | 2/1979 | Bouillon | 89/38 |
| 4,166,406 | A | * | 9/1979 | Maughmer | 89/1.815 |
| 4,282,794 | A | * | 8/1981 | Miller et al. | 89/36.15 |
| 4,305,325 | A | * | 12/1981 | Lange et al. | 89/1.815 |
| 4,802,400 | A | * | 2/1989 | Griffin et al. | 89/1.57 |
| 5,020,412 | A | * | 6/1991 | Adams | 89/1.805 |
| 5,129,308 | A | * | 7/1992 | Fuereder et al. | 89/36.15 |
| 5,452,640 | A | * | 9/1995 | Bovee et al. | 89/1.815 |
| 6,250,195 | B1 | * | 6/2001 | Mendoza et al. | 89/1.59 |
| 6,347,567 | B1 | * | 2/2002 | Eckstein | 89/1.59 |
| 2001/0015126 | A1 | | 8/2001 | Grunewald | |

* cited by examiner

*Primary Examiner*—Bret Hayes
(74) *Attorney, Agent, or Firm*—DeMont & Breyer LLC

(57) ABSTRACT

A deck-mounted inclined munitions launcher is disclosed. In accordance with the illustrative embodiment, the launcher includes a platform, two pivotally-coupled munitions canisters, and a drive system. An exhaust end of each munitions canister is movably coupled to the platform while the launch end of each canister is not coupled to the platform. A drive system engages the exhaust end of each munitions canister. The canisters lay substantially flat, side-by-side, in a pre-launch position. To raise the munitions canisters to a launch position, the drive system pulls the exhaust end of each of the canisters toward one another. Since the canisters are pivotally coupled, the pull of the drive system on the exhaust end of the canisters causes the launch end of each canister to rise in a scissoring motion.

19 Claims, 5 Drawing Sheets

INCLINABLE MUNITIONS LAUNCHER

FIELD OF THE INVENTION

The present invention relates generally to munitions launchers, and more particularly to launchers for firing munitions that require an inclined launch angle.

BACKGROUND OF THE INVENTION

Stealth, which equates to signature management, plays an important part in the design of naval vessels. For surface vessels, the most important signatures are the optical signature, radar signature, infrared signature, and acoustic signature. These signatures are detectable by the sensors of other vessels, aircraft, missiles, and submarines.

The reduction of these signatures provides several important benefits to a vessel, including (1) decreasing the distance at which the vessel can be detected, thereby increasing the likelihood that the vessel will detect others first; (2) obfuscating the true size, shape, type and characteristics of the vessel; and (3) improving the likelihood that decoy and chaff ammunition will be effective in diverting incoming missiles.

The radar signature is measured as radar cross section ("RCS") in $dB/m^2$. Stealth shaping via the use of flat inclined surfaces and the avoidance of corner reflectors has substantially reduced the RCS of naval vessels. In fact, the RCS of the vessel's deck equipment is now typically greater than that of the vessel itself.

One potentially significant contributor to a vessel's RCS is its on-deck missile launch system. To address this, in-deck vertical missile launchers, such as the MK 41 Vertical Launch System, have been developed. Since in-deck launch systems are below the surface of the deck, they have virtually no impact on the vessel's RCS.

Most ship-borne missiles are vertically launched, but there are some missiles that must be launched at an inclined angle (i.e., less than ninety degrees). Since in-deck, vertical missile launchers cannot be used to launch these missiles, a deck-mounted launcher, with its greater RCS, is typically used.

In one type of deck-mounted, inclined missile-launch system, missile canisters are permanently fixed at an appropriate launch angle by a fixed-angle launch structure. This type of launcher presents a large RCS.

Another type of deck-mounted, inclined missile-launch system, includes a tilting launch structure. An example of this type of system is the armored box launcher. This system includes a launch structure that supports the missile canisters and is capable of tilting them between a pre-launch orientation in which they are substantially parallel to the deck of the ship and a launch orientation in which the canisters are inclined to an appropriate launch angle.

Although the armored box launcher does not maintain a fixed launch angle, it nevertheless has a large RCS as a consequence of its sharp corners and boxy structure.

A need therefore exists for an inclined missile launcher that has a relatively low RCS.

SUMMARY OF THE INVENTION

The present invention is capable of launching munitions at an inclined angle from the deck of a vessel without some of the costs and disadvantages of the prior art.

The illustrative embodiment of the present invention is a deck-mounted inclined munitions launcher. In accordance with the illustrative embodiment, the launcher includes a platform, two munitions canisters, and a drive system.

The platform has two low side-walls and a partition that runs lengthwise between the side-walls. The side-walls and partition terminate (at each end) at an end portion of the platform. Each end portion rises above the side-walls and includes an angled face, which slopes toward the deck. Each of the two end portions includes a munitions exhaust-gas management system. The platform is mounted to the deck of a vessel with a thrust bearing structure or other arrangement for transferring the launching load to the deck.

The munitions canisters each contain a munition, typically a missile. An exhaust end of each munitions canister is movably coupled to the platform while the launch end of each canister is not coupled to the platform. A drive system engages the exhaust end of each munitions canister. The munitions canisters are pivotally coupled to one another at about the midpoint of each canister.

In a pre-launch position, the munitions canisters lay substantially flat on the platform, such that they are parallel to the surface of the deck. Lying side-by-side, the launch end of one canister is adjacent to the exhaust end of the other canister. In other words, the missiles in the canisters face opposite sides of the ship, 180 degrees apart. The upper surface of each munitions canister aligns with the apex of the angled face of each end portion of the platform, forming a frusto-pyramidal shape. In this position, the launch system presents a low profile with relatively few hard edges. As a consequence, in the pre-launch orientation, the launcher has a relatively low RCS.

To raise the munitions canisters to a launch position, the drive system pulls the exhaust end of each of the two munitions canisters toward one another. Movement of the exhaust end of each canister is substantially in-plane; that is, they move along the platform in a substantially horizontal path. Since the canisters are pivotally coupled, the pull of the drive system on the exhaust end of the canisters causes the launch end of each canister to rise. This motion is somewhat analogous to closing an upright, fully-open pair of scissors. As the finger-receiving end of the scissors approach each other, the blade ends of the scissors rise, also approaching one another.

In this fashion, the canisters "scissor" upward forming an "x" configuration. Eventually, they stop at a desired degree of incline, which is the launch position. When a munition is launched, exhaust gases leave the exhaust end of the munitions canister and are received by a channel that is formed between one of the side-walls and the partition. Exhaust gases flow from the channel to the exhaust-gas management system in each end portion of the platform. This system directs the exhaust gases away from the munitions launcher and also away from the deck of vessel. This reduces the risk of damage to the canister or deck. This also reduces heating of the canister and the deck and, therefore, reduces the increase in infrared signature that would otherwise occur.

After munitions launch, the operation of the drive system is reversed, so that the drive system pushes the exhaust end of the canisters away from each other. Returning to the scissors analogy, the pushing movement results in downward movement of the launch end of each canister. Eventually, the canisters come to rest on the platform, with their upper surface flush with the apex of the end portions of the platform.

It is notable that for the illustrative launcher, the munitions canisters themselves form a part of the system that raises the canisters to launch position. That is, by virtue of the geometry of the launcher and the pivotal coupling of the canisters, applying a force directly to the canisters causes them to rise or lower. This is unlike prior launchers, wherein a separate tilting platform is used to raise and lower the canisters. The illustrative embodiment therefore provides an inclined launcher that is less complex and less expensive than prior-art inclined launchers, in addition to exhibiting a lower RCS.

BRIEF DESCRIPTION OF THE DRAWINGS

In FIG. 1A, the launcher is depicted in a pre-launch position.

In FIG. 1B, the launcher is depicted in a pre-launch position.

In FIG. 2A, the launcher is depicted in a launch position.

In FIG. 2B, the launcher is depicted in a launch position

DETAILED DESCRIPTION

Figure 1B:
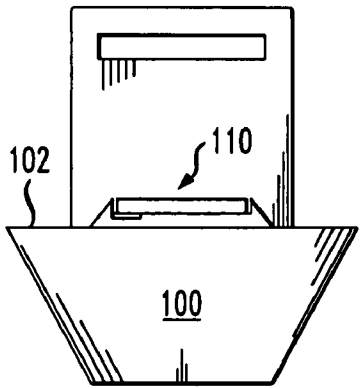
FIG. 1B depicts a front view of a vessel having a deck-mounted, inclined munitions launcher in accordance with the illustrative embodiment of the present invention.
Figure 1A:
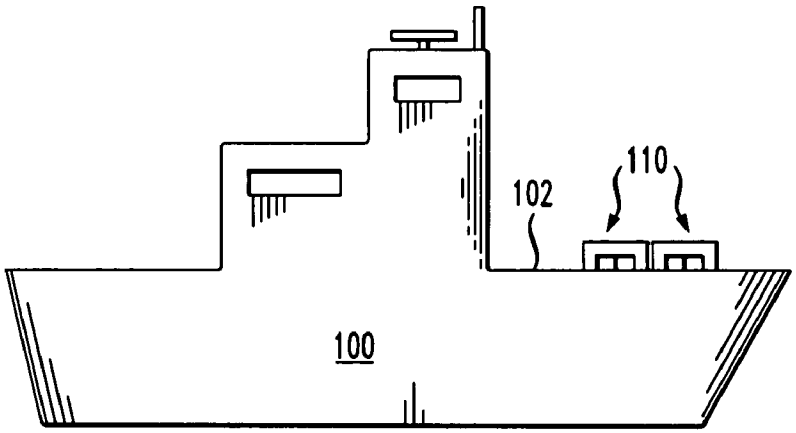
FIG. 1A depicts a side view of a vessel having a deck-mounted, inclined munitions launcher in accordance with the illustrative embodiment of the present invention.

FIGS. 1A and 1B depict respective side and front views of waterborne vessel 100 having deck 102. Coupled to the deck is inclined munitions launcher 110 in accordance with the illustrative embodiment of the present invention. In these Figures, munitions launcher 110 is in a pre-launch position.

Figure 2B:
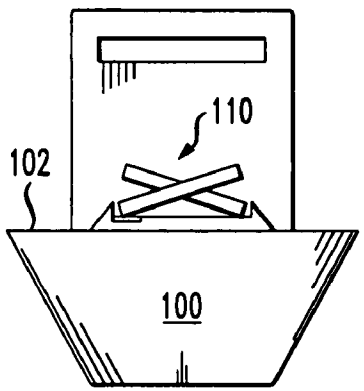
FIG. 2B depicts a front view of a vessel having a deck-mounted, inclined munitions launcher in accordance with the illustrative embodiment of the present invention.
Figure 2A:
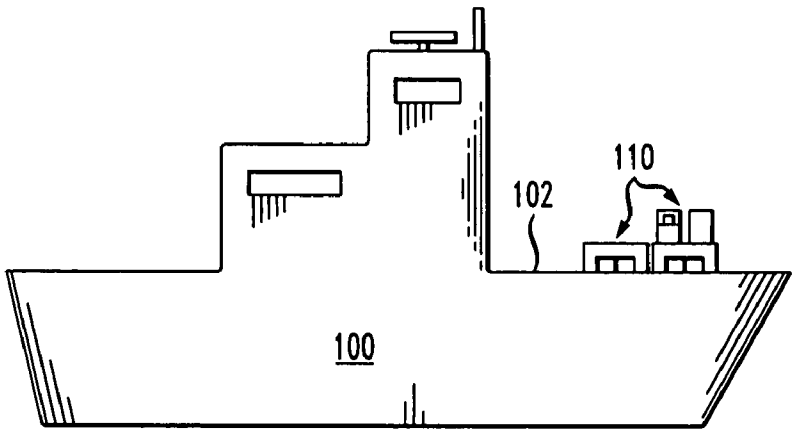
FIG. 2A depicts a side view of a vessel having a deck-mounted, inclined munitions launcher in accordance with the illustrative embodiment of the present invention.

FIGS. 2A and 2B depict respective side and front views of vessel 100, but in these Figures, munitions launcher 110 is depicted with two munitions canisters (of four) inclined in a launch position. As is observable from FIGS. 2A and 2B, munitions launcher 110 is capable of launching munitions in opposite directions (e.g., both port and starboard).

While FIGS. 1A-1B and 2A-2B depicts munitions launcher 110 at a location that is proximal to the bow of vessel 100, in some other embodiments, it is located aft.

Figure 3C:
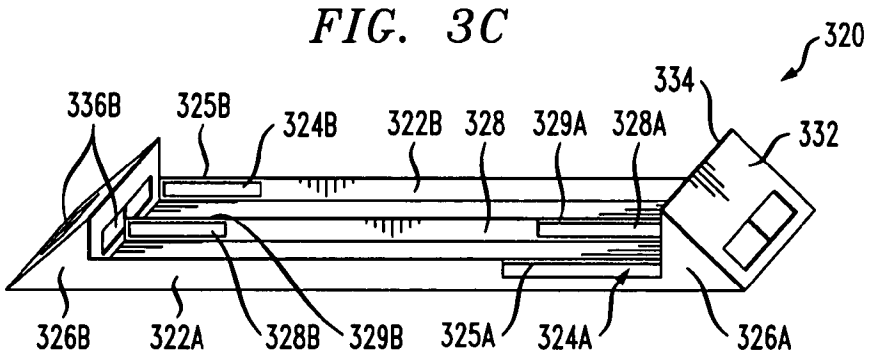
FIG. 3C depicts a perspective view of the munitions launcher of FIG. 3B, again without the munitions canisters.
Figure 3D:
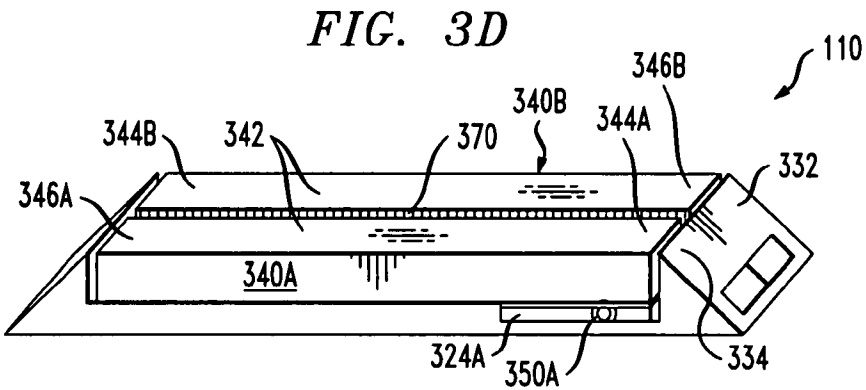
FIG. 3D depicts a perspective view of the munitions launcher as in FIG. 3B, but now with the munitions canisters in place.
Figure 3B:
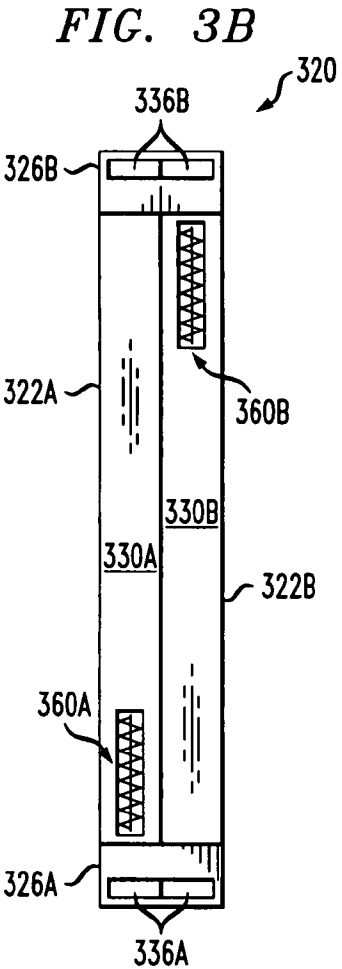
FIG. 3B depicts a top view of the munitions launcher as in FIG. 3A, but without the munitions canisters, thereby showing further details of the launcher platform.

FIGS. 3A-3D depict further detail of munitions launcher 110. All of these figures depict the munitions launcher in a pre-launch configuration. FIGS. 3B and 3C depict the munitions launcher without the munitions canisters, which would otherwise obscure certain details of munitions launcher.

Referring now to FIGS. 3A-3D, munitions canister 110 includes platform 320, which is normally coupled to the deck of a vessel, such as vessel 100 of FIG. 1A. Platform 320 is typically coupled to the deck via a thrust bearing structure or other arrangement that transfers the launching loads to the deck of the vessel.

Platform 320 has a generally elongated, rectangular shape, as defined by two side-walls 322A and 322B and two end portions 326A and 326B. Partition 328 is disposed between and parallel to side-walls 322A and 322B. The side-walls and partition collectively define two channels 330A and 330B.

The upper edge of side-wall 322A is recessed near end portion 326A. Rail 325A overlies the recess, thereby forming slot 324A. Likewise, the upper edge of side-wall 322B is recessed near end portion 326B. Rail 325B overlies the recess, thereby forming slot 324B. As depicted in FIG. 3C, these slots are located at opposite ends of platform 320.

The upper edge of partition 328 is recessed at both ends. Rails 329A and 329B overlie the recesses, thereby forming respective slots 328A and 328B. As described later in this specification, slots 324A and 328A are used for coupling munitions canister 340A to platform 320. Similarly, slots 324B and 328B are used for coupling munitions canister 340B to platform 320.

The upper surface of each end portion 326A, 326B defines angled face 332. Apex 334 of angled face 332 is higher than the upper edge of side-walls 322A and 322B and partition 328. End portion 326A includes an exhaust-gas management system comprising port 336A and end portion 326B includes an exhaust-gas management system comprising port 336B. The ports extend completely through each end portion and communicate with channels 330A and 330B.

Figure 3A:
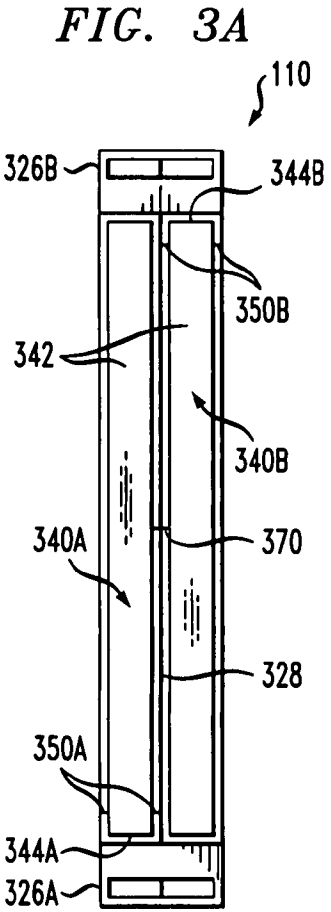
FIG. 3A depicts, via a top view, further detail of the munitions launcher of FIG. 1A.

As depicted in FIGS. 3A and 3D, two munitions canisters 340A and 340B occupy respective channels 330A and 330B. The munitions canisters are pivotally coupled to one another by hinge 370. In the illustrative embodiment, hinge 370 is disposed at the mid-point of munitions canisters 340A and 340B, near upper surface 342 thereof.

Referring now to FIGS. 3A and 3D, two coupling elements 350A depend from the sides of munitions canister 340A near to exhaust end 344A thereof. One of these coupling elements engages slot 324A in side-wall 322A and the other (not depicted in FIG. 3D) engages slot 328A in partition 328. Similarly, two coupling elements 350B depend from the sides of munitions canister 340B near to exhaust end 344B thereof. One of these coupling elements engages slot 324B (in side-wall 322B) and the other engages slot 328B (in partition 328).

Coupling elements 350A couple munitions canister 340A to platform 320 in a manner that enables exhaust end 344A to move in either direction along channel 330A. The extent of this movement is restricted by the length of slots 324A and 328A. Coupling elements 350B likewise movably couple munitions canister 340B to platform 320, enabling exhaust end 344B to move in either direction along channel 330B. Again, the extent of this movement is limited by the length of slots 324B and 328B. Coupling elements 350A and 350B can be any of a variety of elements, such as rollers, slides, pulleys, etc., that offer low resistance to movement, thereby facilitating movement of the exhaust end of the munitions canisters.

In FIGS. 3A-3D, 4A-4C, and 5, hinge 370 and coupling elements 350A and 350B are depicted as being integral to munitions canisters 340A and 340B. Munitions canisters are not typically fabricated to include these features. As a consequence, to integrate the hinge and coupling elements as shown, standard munitions canisters will have to be modified. Alternatively, munitions canisters that are dedicated for use with munitions launcher 110 can be manufactured to include these features.

It is desirable not to have to modify munitions canisters or produce special-use canisters for use with munitions launcher 110. As an alternative to those approaches, hinge 370 and coupling elements 340A and 340B can be "add-on" features, which clamp or otherwise attach to standard munitions canisters. An embodiment of a clamp-on hinge and coupling elements are described later in this specification in conjunction with FIG. 5.

Launch end 346A of munitions canister 322A and launch end 346B of munitions canister 322B are not tethered to platform 320.

Drive system 360A is disposed in channel 330A near end portion 326A and drive system 360B is disposed in channel 330B near end portion 326B. Drive system 360A couples to exhaust end 344A of munitions canister 340A. Similarly, drive system 360B couples to exhaust end 344B of munitions canister 340B.

The drive systems are capable of moving the exhaust end of the munitions canisters towards one another and away from one another. In other words, drive system 360A can move exhaust end 344A of munitions canister 340A toward either end of slot 324A (and slot 328A) and drive system 360B can move exhaust end 344B of munitions canister 340B toward either end of slot 324B (and slot 328B).

Any of a variety of drives known to those skilled in the art can suitably be used as drives 360A and 360B, such as screw drives, etc.

Due to the presence of hinge 370, as drive systems 360A and 360B force the exhaust end of the two munitions canisters toward one another, the launch end of the canisters will rise. More particularly, as the exhaust end of each of the canisters is forced toward the other, the canisters pivot about hinge 370. It will be appreciated that some provision must be made to slightly raise the launch end (or drop the exhaust end) to enable lateral (and vertical) movement of the canisters. That is, if the canisters are co-planar in the pre-launch position, opposing in-plane forces will not be able to move them. In some embodiments, this issue is addressed using a pin or rod that is disposed underneath the launch end of each canister and that is driven upward, thereby slightly inclining the canisters, prior to engaging drives 360A and 360B.

To lower the canisters, the operation of drive systems 360A and 360B are reversed, so that the exhaust ends of munitions canisters 340A and 340B are forced away from one another. This causes the free launch end of the munitions canisters to drop toward platform 320.

Figure 4A:
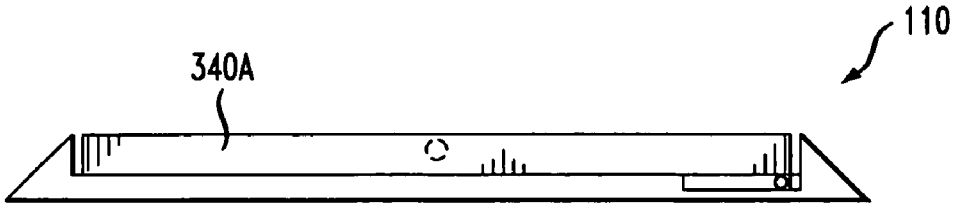
FIGS. 4A-4C depict, sequentially, the munitions canisters in a pre-launch position, then rising to the launch position.
Figure 4B:
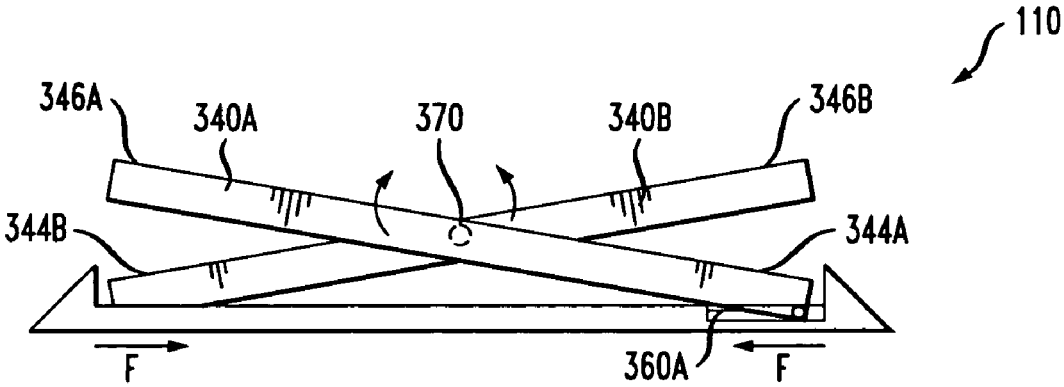
Figure 4C:
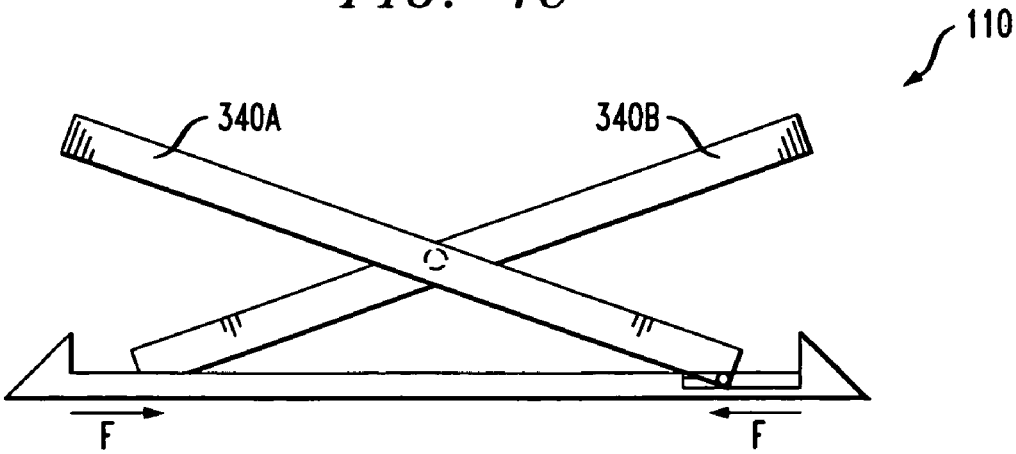

The operation of raising munitions canisters 340A and 340B is depicted in FIGS. 4A-4C. It will be observed from these figures that the motion of the munitions canisters is somewhat analogous to the movement of a pair of vertically-oriented scissors as they are closed and opened.

FIG. 4A depicts the munitions canisters (only 340A is visible) in the pre-launch position, wherein they are in a horizontal, co-planar orientation. FIG. 4B depicts force F being applied such that exhaust end 344A and 344B of respective munitions canisters 340A and 340B are forced towards one another. In the illustrative embodiment, this force is applied via drive system 360A (for canister 340A) and via drive system 360B (for canister 340B). Drive system 360B is not visible in FIGS. 4A-4C. As the force is applied, the munitions canisters partially rotate about hinge 370 and launch end 346A of munitions canister 340A and launch end 346B of munitions canister 340B rise.

FIG. 4C depicts canisters 340A and 340B fully inclined in a launch position. To achieve this position, drive systems 360A and 360B applied a continuing force F, thereby pulling the exhaust ends of canisters 340A and 340B further towards one another relative to FIG. 4B.

As previously disclosed, it is desirable to engage hinge 370 and coupling elements 340A and 340B as "add-on" features to standard munitions canisters. An illustrative embodiment of an end clamp and center clamp is depicted in FIG. 5.

Figure 5:
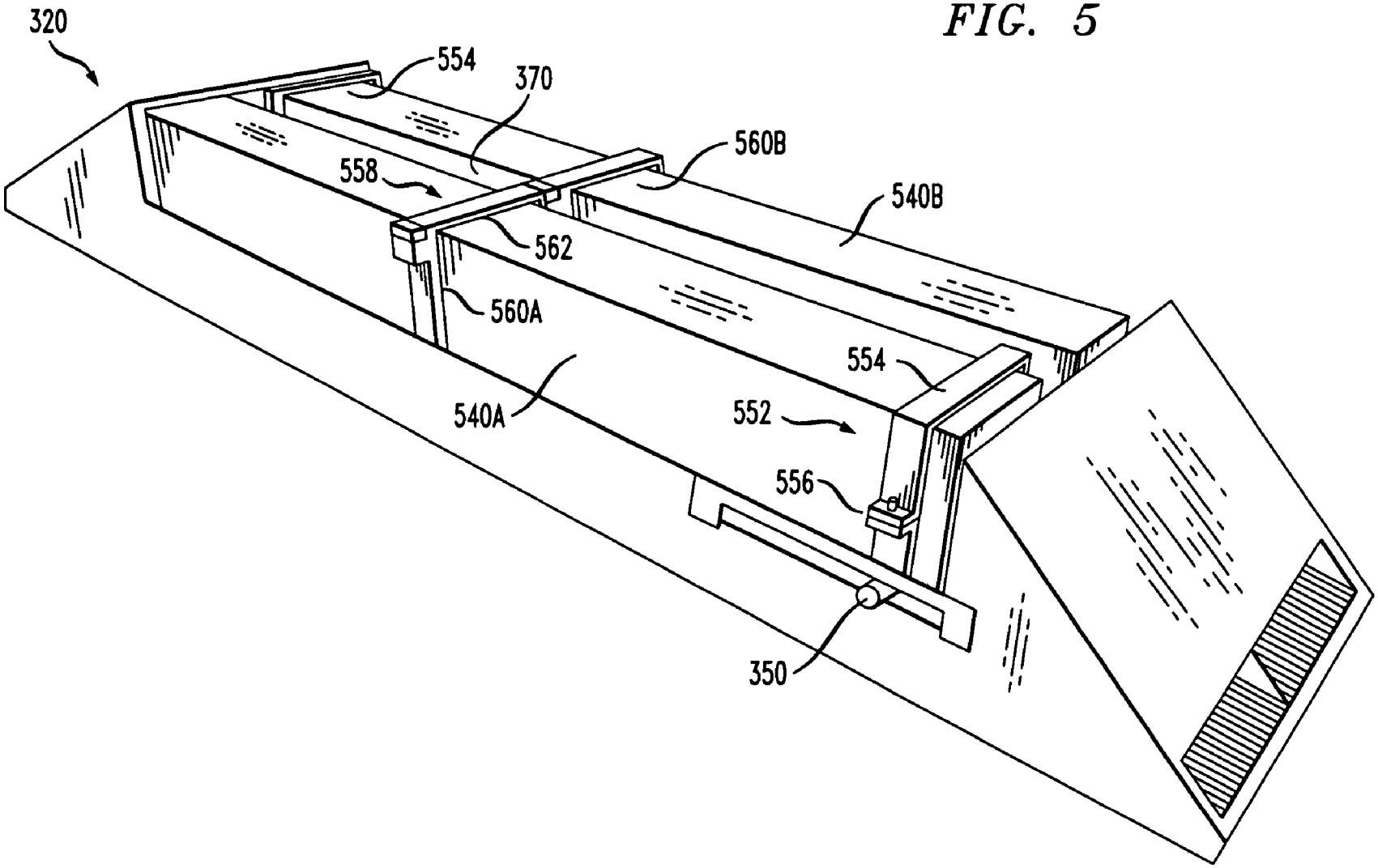
FIG. 5 depicts an embodiment of an end clamp and center clamp for use in pivotably coupling standard munitions canisters to one another and for coupling standard munitions canisters to the launcher platform.

With reference to FIG. 5, each end clamp 552 includes clamp body 554, locking mechanism 556, and coupling element 350. Holes (not depicted) in clamp body 554 receive pins to provide further restraint to any movement of end clamp 552 once it is attached to a munitions canister. Identical versions of end clamp 552 are attached to standard munitions canister 540A and 540B.

Center clamp 558 comprises clamp body 560A and clamp body 560B, which are attached to respective standard munitions canisters 540A and 540B. Like end clamp 552, clamp body 560A and 560B includes holes (not depicted) that receive pins to restrain movement of center clamp 558. Hinge 370 is implemented in any of a variety of ways for use with center clamp 558. For example, in some embodiments, hinge 370 is a rod that is received by clamp body 560A and 560B. In some embodiments, each clamp body 560A and 560B has a hole through upper member 562 for receiving the rod internally. In some other embodiments, tabs, each with a hole for receiving the rod, etc., depend from upper member 562 of each clamp body 560A, 560B. It will be appreciated by those skilled in the art, after reading the present disclosure, that there are many ways in which to hingeably couple clamp body 560A to clamp body 560B to enable the scissoring action that is required to raise standard munitions canisters 540A and 540B to launch position.

Again, the functionality provided by center clamp 558 is an ability to (i) hingeably couple two munitions canisters and (ii) support the twisting or torsional forces that arise from pivotably coupling the canisters near the upper major surface of the canisters as opposed to a more centered position between the upper and lower major surfaces of the canisters. The functionality provided by end clamps 552 is an ability to movably couple the munitions canisters to platform 320. The specific configuration of end clamps 552 and center clamp 558 is not of particular importance as long as the required functionality is provided. Rather, the importance of these clamps is that they enable standard, unaltered munitions canisters to be used in conjunction with munitions launcher 110.

Figure 6:
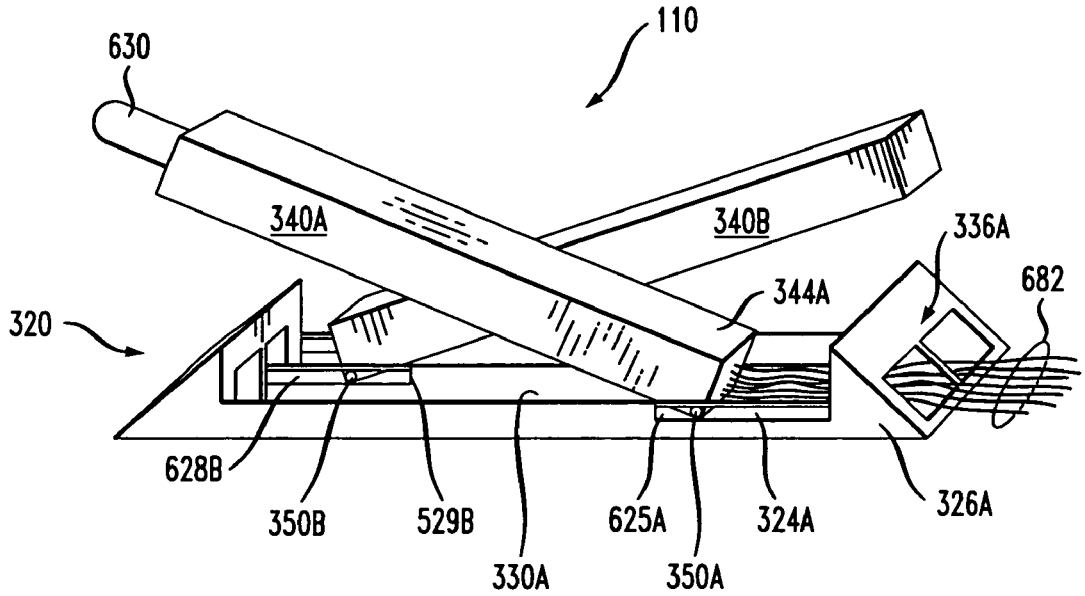
FIG. 6 depicts a perspective view of the munitions launcher of FIG. 3D, wherein the launcher is shown in a launch position.

FIG. 6 depicts a perspective view of inclined launcher 110, wherein munitions canisters 340A and 340B are inclined in a launch position. It is seen that coupling elements 350A and 350B have moved toward the inside edge 625A of slot 324A and inside edge 629B of slot 628B, respectively.

As missile 680 fires, exhaust gases 682 exit from exhaust end 344A of munitions canister 340A. The exhaust gases flow into channel 330A and then to port 336A of the exhaust-gas management system of end portion 326A. The exhaust gases exit platform 320 through port 336A and are directed away from the deck of the vessel (not depicted in FIG. 6).

Figure 7:
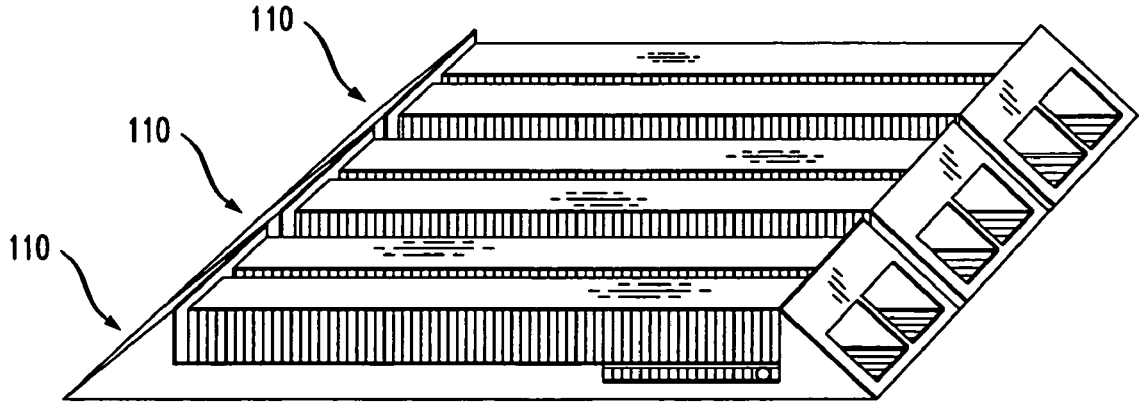
FIG. 7 depicts a plurality of the illustrative munitions launchers side-by-side.

In most applications, a plurality of inclined munitions launchers 110 are grouped together to provide a greater threat capability. For example, FIG. 7 depicts three munitions launchers 110 grouped together, which would provide the capability of launching six missiles, three to port and three to starboard.

It is to be understood that the above-described embodiments are merely illustrative of the present invention and that many variations of the above-described embodiments can be devised by those skilled in the art without departing from the scope of the invention.

For example, in the illustrative embodiment, inclined munitions launcher includes two drive systems 360A and 360B. In some alternative embodiments, a single drive system, which is coupled to the exhaust end of only one of the munitions canister, is used. Also, in the illustrative embodiment, the drive system pulls the exhaust end of the canisters to move them to a launch position. But in some other embodiments, as a function of the specific arrangement and location of the drive system, the drive systems pushes the exhaust end of the canisters to move them to an inclined position. In yet some additional embodiments, the drive system applies an upward- or downward-directed force to move the munitions canisters to an inclined position, rather than a laterally-directed force, as in the illustrative embodiment. In some other embodiments, more than two missile canisters are pivotally coupled to one another.

The alternative embodiments listed above are a few of the many variations that will occur to those skilled in the art after reading this disclosure. It is therefore intended that such variations, and others that will occur to those skilled in the art in view of the present disclosure, be included within the scope of the following claims and their equivalents.

We claim:

1. An apparatus comprising:

at least two munitions canisters, wherein each munition canister has a launch end and an exhaust end;

a pivoting element for pivotably coupling said two munitions canisters to one another; and a drive, wherein said drive is coupled to at least one of said munitions canisters proximal to said exhaust end thereof, and wherein said drive applies a force to an end of said at least one munition canister, and further wherein the force is co-linear with respect to said at least one munition canister when said canister is in a pre-launch position.

2. The apparatus of claim 1 wherein a direction of said force causes said munitions canisters to scissor about said pivoting element such that said launch end of each said munitions canisters rises above said exhaust end thereof, thereby placing said munitions canisters in a launch position.

3. The apparatus of claim 2 wherein in said launch position, said munitions canisters are at an acute angle with respect to a support surface.

4. The apparatus of claim 2 wherein, when said munitions canisters are in said launch position, a direction of said force causes said munitions canisters to scissor about said pivoting element such that said launch end of each said munitions canister drops to a position in which said munitions canisters are horizontal, thereby placing said munitions canisters in said pre-launch position.

5. The apparatus of claim 1 wherein said two munitions canisters are facing in opposite directions from one another.

6. The apparatus of claim 1 further comprising a platform, wherein said platform comprises two channels for receiving said two munitions canisters.

7. The apparatus of claim 6 wherein said channels are defined between sidewalls and two ends of said platform.

8. The apparatus of claim 7 wherein each of said ends of said platform have an angled face.

9. The apparatus of claim 7 wherein each of said ends of said platform comprise an exhaust gas management system, wherein said exhaust gas management system receives exhaust gas from a munition that is launched from a respective munitions canister.

10. The apparatus of claim 1 further comprising at least one munition, wherein said munition is disposed within one of said munitions canisters.

11. An apparatus comprising:

a platform;

a first munitions canister having a launch end and an exhaust end;

a second munitions canister having a launch end and an exhaust end, wherein said first munitions canister and said second munitions canister are pivotably coupled to one another, and further wherein said first munitions canister and said second munitions canister are movably coupled to said platform at said exhaust end; and a drive, wherein said drive is operative to apply a force to one of either said launch end or said exhaust end of said first munitions canister, and further wherein application of said force to said first munitions canister will move both of said first munitions canister and said second munitions canister to a launch position or a pre-launch position as a function of an initial position of said first munitions canister and said second munitions canister.

12. The apparatus of claim 11 wherein when said force is applied, said first munitions canister and said second munitions canister move in a scissoring fashion.

13. The apparatus of claim 11 wherein said platform comprises:

a first side wall and a second side wall, wherein said first and second side walls are parallel to one another;

a partition disposed between and parallel to said first and second side walls; and a first end portion disposed at one end of said first side wall, said partition, and said second side wall; and a second end portion disposed at another end of said first side wall, said partition, and said second side wall.

14. The apparatus of claim 13 wherein said first end portion comprises a gas management system for receiving exhaust gas from said exhaust end of said first munitions canister.

15. The apparatus of claim 13 wherein said first end portion has an angled face and said second end portion has an angled face.

16. The apparatus of claim 11 wherein said first and second munitions canisters scissor between a pre-launch position and a launch position when said force is applied proximal to said exhaust end of said first munitions canister as a function of a direction of said force, wherein:

in said pre-launch position, an upper surface of each of said first and second munitions canisters are co-planar with one another; and in said launch position, said launch end of each of said first and second munitions canisters is elevated above said exhaust end of each of said first and second munitions canisters and said munitions canisters form an acute angle relative to said platform.

17. The apparatus of claim 16 wherein in said pre-launch position, said upper surface of said first and second munitions canisters are substantially co-planar with an apex of said first and second end portions.

18. An apparatus comprising:

a first munitions canister; and a second munitions canister, wherein:

said first and second munitions canisters are pivotably coupled to one another at a pivot point; and under the action of an applied force, and as a function of a direction of said applied force, said first and second munitions canisters partially rotate in opposite directions about said pivot point, scissoring upward into a launch position or scissoring downward to a pre-launch position.

19. The apparatus of claim 18 wherein said first munitions canister and said second munitions canister face opposite directions.

* * * * *